US005987772A

United States Patent [19]

Cheng

[11] Patent Number: 5,987,772

[45] Date of Patent: Nov. 23, 1999

[54] HAIR DRIER

[76] Inventor: Jiun-Liang Cheng, 58, MA Yuan West St., Taichung, Taiwan

[21] Appl. No.: 09/170,148

[22] Filed: Oct. 13, 1998

[51] Int. Cl.[6] ..... A45D 20/06

[52] U.S. Cl. ..... 34/97; 34/96; 432/222

[58] Field of Search ..... 34/96, 97; 432/219, 432/222; 126/401, 409

[56] References Cited

U.S. PATENT DOCUMENTS

| | | | |
|---|---|---|---|
| 4,603,246 | 7/1986 | Costa | 219/370 |
| 5,155,925 | 10/1992 | Choi | 34/97 |
| 5,608,975 | 3/1997 | Hsu | 34/97 |

FOREIGN PATENT DOCUMENTS 2170705A 8/1986 United Kingdom .

*Primary Examiner*—Henry Bennett
*Assistant Examiner*—Pamela A. Wilson

[57] ABSTRACT

A hair drier has a hollow handle, a barrel support device disposed on the hollow handle, and a barrel disposed on the barrel support device. The barrel has a through hole, a heat collection net, a fan, and a motor. A flame nozzle is disposed in the barrel support device. A gas igniter is disposed in the barrel support device in front of the flame nozzle. The hollow handle has a gas chamber, a battery chamber, a gas adjustment button, a motor speed adjustment button, and an ignition button. A gas pipe is connected to the flame nozzle and the gas chamber.

2 Claims, 4 Drawing Sheets

HAIR DRIER

BACKGROUND OF THE INVENTION

The present invention relates to a hair drier. More particularly, the present invention relates to a hair drier which can use a direct current instead of an alternating current in order to ignite a gas igniter.

A conventional hair drier has a heat focus net. An alternating current of 7 amperes to 11 amperes will produce a power of 800 watts to 1200 watts in order to heat the heat focus net. However, a battery may produce a voltage of 12 volts to 24 volts in order to produce a direct current of 30 amperes to 100 amperes. In other words, the battery will be consumed in less than one hour. Therefore, most people consider it is not possible to use a direct current instead of an alternating current for a hair drier.

SUMMARY OF THE INVENTION

An object of the present invention is to provide a hair drier which can use a direct current instead of an alternating currert in order to ignite a gas igniter.

Accordingly, a hair drier comprises a hollow handle, a barrel support device disposed on the hollow handle, and a barrel disposed on the barrel support device. A through hole is formed on a bottom of the barrel. A heat collection net is disposed in a middle portion of the barrel matching the through hole. A fan is disposed in a lower portion of the barrel. A motor is disposed on the fan. A flame nozzle is disposed in the barrel support device. A gas igniter is disposed in the barrel support device in front of the flame nozzle. The hollow handle comprises a gas chamber, a battery chamber, a gas adjustment button, a motor speed adjustment button, and an ignition button. A gas pipe is connected to the flame nozzle and the gas chamber. The battery chamber receives at least a battery. A first wire is connected to the motor and the battery. A second wire is connected to the gas igniter and the battery.

DETAILED DESCRIPTION OF THE INVENTION

Figure 1:
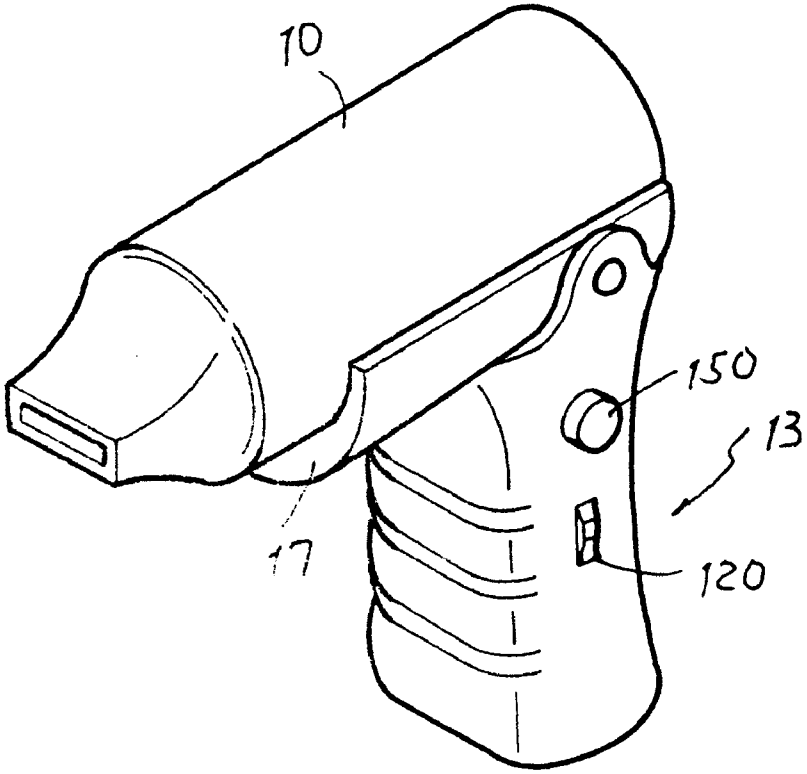
FIG. 1 is a perspective assembly view of a hair drier of a preferred embodiment in accordance with the present invention.
Figure 2:
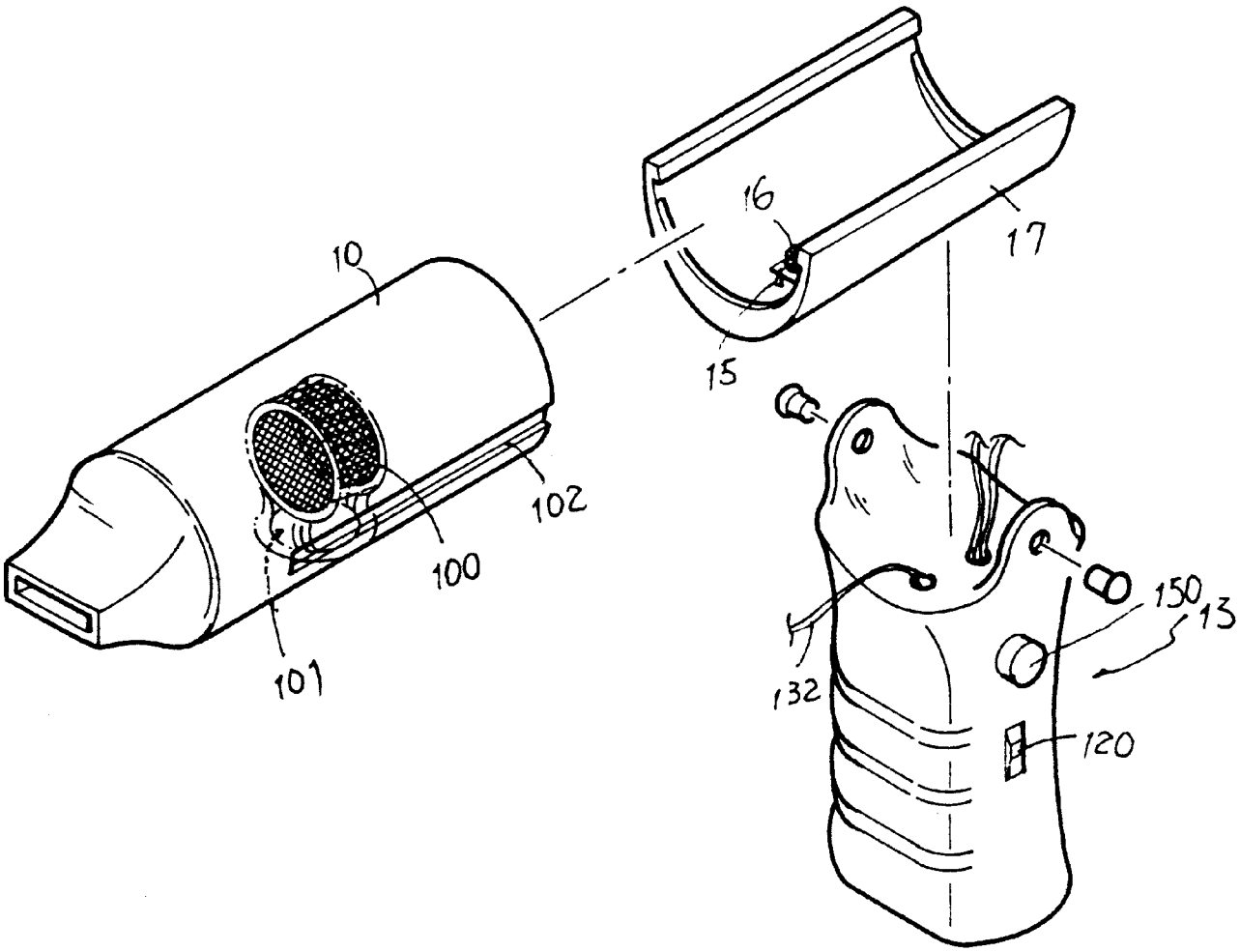
FIG. 2 is a perspective exploded view of a hair drier of a preferred embodiment in accordance with the present invention.
Figure 3:
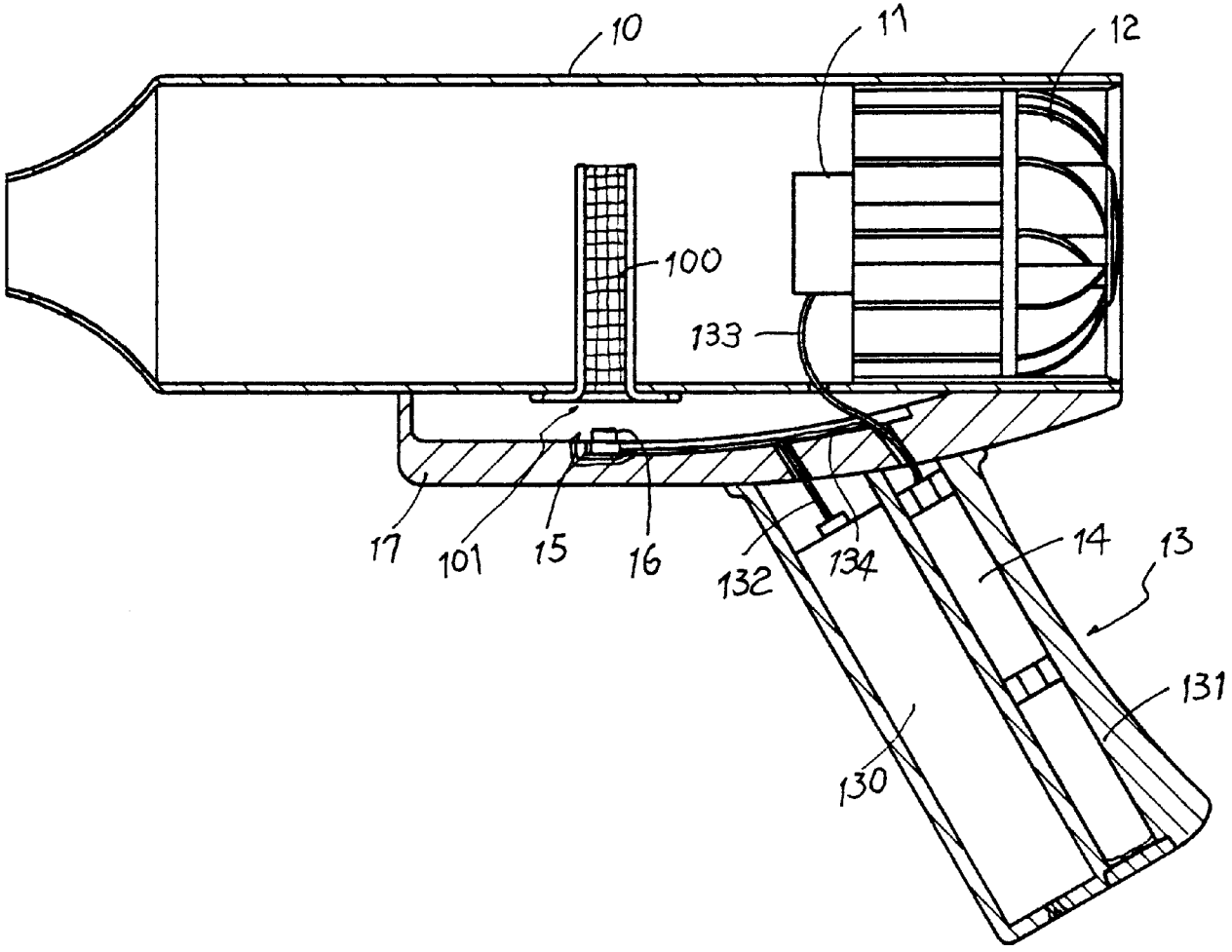
FIG. 3 is a sectional view of FIG. 1.
Figure 4:
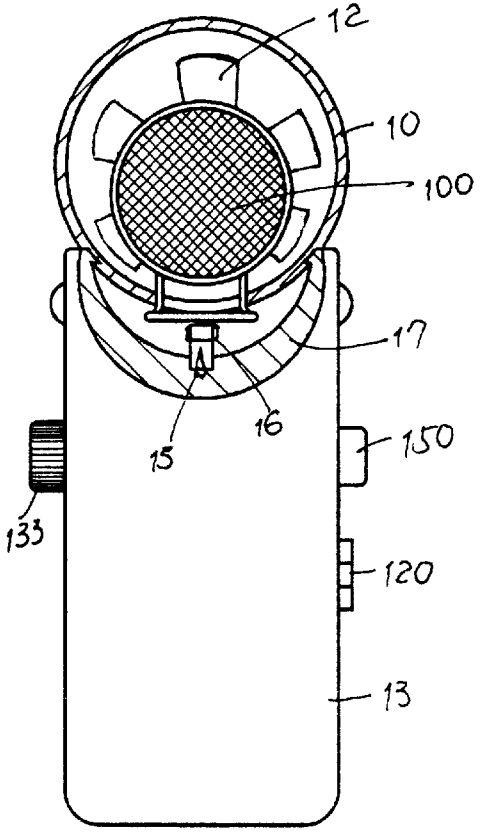
FIG. 4 is another sectional view of FIG. 1.

Referring to FIGS. 1 to 4, a hair drier comprises a hollow handle 13, a barrel support device 17 disposed on the hollow handle 13, and a barrel 10 disposed on the barrel suppcrt device 17. A through hole 101 is formed on a bottom of the barrel 10. A heat collection net 100 is disposed in a middle portion of the barrel 10 matching the through hole 101. A fan 12 is disposed in a lower portion of the barrel 10. A motor 11 is disposed on the fan 12 in order to drive the fan 12. Two slide grooves 102 are formed on two laterals of the barrel 10. A flame nozzle 16 is disposed in the barrel support device 17. A gas igniter 15 is disposed in the barrel support device 17 in front of the flame nozzle 16. The barrel support device 17 is inserted in the slide grooves 102. The hollow handle 13 comprises a gas chamber 130, a battery chamber 131, a gas, adjustment button 133, a motor speed adjustment button 120, and an ignition button 150. A gas pipe 132 is connected to the flame nozzle 16 and the gas chamber 130. The battery chamber 131 receives at least a battery 14. A first wire 133 is connected to the motor 11 and the battery 14. A second wire 134 is connected to the gas igniter 15 and the battery 14.

The heat collection net 100 is made of heat collection materials such as metals or ceramics.

Since the hair drier uses a direct current to ignite the gas igniter 15 and the motor 11, the battery 14 can be used for a long period of time. The battery 14 need not heat the heat collection net 100 directly.

The present invention is not limited to the above embodiment but various modification thereof may be made. Furthermore, various changes in form and detail may be made without departing from the scope of the present invention.

I claim:

1. A hair drier comprises:

a hollow handle, a barrel support device disposed on the hollow handle, and a barrel disposed on the barrel support device, a through hole formed on a bottom of the barrel, a heat collection net disposed in a middle portion of the barrel matching the through hole, a fan disposed in a lower portion of the barrel, a motor disposed on the fan, a flame nozzle disposed in the barrel support device, a gas igniter disposed in the barrel support device in front of the flame nozzle, the hollow handle comprising a gas chamber, a battery chamber, a gas adjustment button, a motor speed adjustment button, and an ignition button, a gas pipe connected to the flame nozzle and the gas chamber, the battery chamber receiving at least a battery, a first wire connected to the motor and the battery, and a second wire connected to the gas igniter and the battery.

2. A hair drier as claimed in claim 1, wherein two slide grooves are formed on two laterals of the barrel.

* * * * *